US011606652B2

(12) United States Patent
Petersen

(10) Patent No.: US 11,606,652 B2
(45) Date of Patent: Mar. 14, 2023

(54) DISTORTION COMPENSATION FOR BONE ANCHORED HEARING DEVICE

(71) Applicant: Oticon Medical A/S, Smørum (DK)

(72) Inventor: Jan Petersen, Smørum (DK)

(73) Assignee: OTICON MEDICAL A/S, Smørum (DK)

( * ) Notice: Subject to any disclaimer, the term of this patent is extended or adjusted under 35 U.S.C. 154(b) by 0 days.

(21) Appl. No.: 17/508,270

(22) Filed: Oct. 22, 2021

(65) Prior Publication Data

US 2022/0132256 A1 Apr. 28, 2022

(30) Foreign Application Priority Data

Oct. 23, 2020 (EP) ..... 20203503

(51) Int. Cl.
*H04R 25/00* (2006.01)

(52) U.S. Cl.
CPC ..... *H04R 25/606* (2013.01); *H04R 25/453* (2013.01); *H04R 2225/67* (2013.01)

(58) Field of Classification Search
CPC . H04R 25/00; H04R 2225/67; H04R 2460/13
See application file for complete search history.

(56) References Cited

U.S. PATENT DOCUMENTS

2010/0296659 A1* 11/2010 Tanaka ..... H04R 3/04 381/57
2013/0208935 A1 8/2013 Håkansson
2016/0183002 A1 6/2016 Vinayak
2018/0372692 A1* 12/2018 Bergs ..... H02K 33/00
2021/0168542 A1* 6/2021 Qi ..... H04R 25/606
2022/0021972 A1* 1/2022 Brimijoin, II ..... H04R 5/033

FOREIGN PATENT DOCUMENTS

CN 105721973 A 6/2016

OTHER PUBLICATIONS

Extended European Search Report for European Application No. 21201181.1, dated Feb. 24, 2022.

* cited by examiner

*Primary Examiner* — Suhan Ni
(74) *Attorney, Agent, or Firm* — Birch, Stewart, Kolasch & Birch, LLP

(57) ABSTRACT

A bone anchored hearing device includes an electromagnetic vibrator for generating a vibration in order to transmit sound through a bone of a user to an ear of the user; and a compensator for at least in part compensating a distortion in the vibration of the electromagnetic vibrator. Further, a signal processing method for a bone anchored hearing device includes providing, by an input transducer, an electric input signal representing sound of a surrounding of a user of the bone anchored hearing device; processing, by a signal processing unit, the electric input signal and providing a processed electric signal; generating, by an electromagnetic vibrator, based on the processed electric signal, a vibration in order to transmit sound through a bone of the user to an ear of the user; and at least in part compensating, by a compensator, a distortion in the vibration of the electromagnetic vibrator.

19 Claims, 6 Drawing Sheets

DISTORTION COMPENSATION FOR BONE ANCHORED HEARING DEVICE

FIELD OF THE DISCLOSURE

The present disclosure relates to a bone anchored hearing device and to a signal processing method for a bone anchored hearing device.

BACKGROUND

Bone anchored hearing devices typically use a vibrator/transducer technology to vibrate sound into the skull of a patient based on variable reluctance. To this end, the vibrator includes an anchor and a vibrator mean including a magnet and a coil. In addition to the vibrator, an implant, such as a titanium screw, is applied into the skull of the patient, and an abutment is applied onto the screw. Then, the vibrator is arranged onto the abutment via the anchor. As soon as a supply voltage is provided to the vibrator, the vibrator mean causes the anchor to vibrate by transferring a magnetic force to the anchor. As a result, the anchor moves along a longitudinal direction, applying a vibrational force to the abutment, which in turn transfers the vibration into the skull of the patient.

Ideally, the (output) transducer would have a symmetric movement with low distortion.

However, the magnetic force between the anchor and the magnet depends on their distance (the magnetic force increases with decreasing distance and decreases with increasing distance). This variation of the magnetic force in dependence of the distance leads to an asymmetric behavior of the vibrator, i.e. the magnetic force is not the same throughout the movement of the vibrator. Hence, the movement does not have a linear relation to an input signal, effectively leading to unwanted distortions in the vibration.

The problem described above applies to variable reluctance vibrators as well as other systems with an asymmetrical behavior.

SUMMARY OF EXEMPLARY EMBODIMENTS

It is thus an object to provide a bone anchored hearing device and a signal processing method for a bone anchored hearing device that allow for vibrating sound into the skull of a user while the output signal (and thus the signal perceived by the user) is free of or only has minimal unwanted distortions, thereby improving the hearing experience of the user.

According to a first aspect of the present disclosure, a bone anchored hearing device is provided, the bone anchored hearing device comprising an electromagnetic vibrator for generating a vibration in order to transmit sound through a bone of a user to an ear of the user; and a compensator for at least in part compensating a distortion in the vibration of the electromagnetic vibrator.

According to a second aspect of the present disclosure, a signal processing method for a bone anchored hearing device, in particular a bone anchored hearing device according to the first aspect, is provided, the method comprising: providing, by an input transducer, an electric input signal representing sound of a surrounding of a user of the bone anchored hearing device; processing, by a signal processing unit, the electric input signal and providing a processed electric signal; generating, by an electromagnetic vibrator, based on the processed electric signal, a vibration in order to transmit sound through a bone of the user to an ear of the user; and at least in part compensating, by a compensator, a distortion in the vibration of the electromagnetic vibrator.

According to a further aspect a computer program is also disclosed, comprising instructions which, when the program is executed by a computer, cause the computer to carry out (steps of) the method of the second aspect Exemplary embodiments of the first and the second aspect may have one or more of the properties described below.

In an exemplary embodiment, the electromagnetic vibrator is a part of or is an output transducer configured for receiving an electric input signal and/or providing a mechanical output signal to the bone of the user.

Thereby, in an exemplary embodiment, the electric input signal represents the sound from the surrounding of the user. In other words, in an exemplary embodiment, physical properties of the sound are represented by the electric input signal.

The mechanical output signal may correspond to an acoustic signal such as mechanical vibrations reaching the user's inner ear (the vibration).

In an exemplary embodiment, the sound transmitted by the electromagnetic vibrator is a sound from a surrounding of the user. In this way, the electromagnetic vibrator advantageously allows for improving or augmenting the hearing capability of the user.

At least in part compensating a distortion in the vibration with the compensator is in particular understood as (at least in part) reducing, preventing, and/or avoiding a respective distortion in the vibration, which would otherwise occur in the vibration in the absence of the compensator.

A compensator may generally be realized by software and/or hardware. For instance, the compensator may be a software or hardware module. The compensator may be implemented in one or more otherwise already present modules of the hearing device, such as a signal processing unit. The compensator may be employed to work with signals in the digital domain and/or in analog domain.

The suggested approach allows to provide an output signal (and thus a signal perceived by the user), which is free of or only has minimal unwanted distortions, even though an electromagnetic vibrator is used, which usually is intrinsically susceptible for such distortions due to the physical working principles of electromagnetic vibrators, which will also be explained in further detail below. Thus, it is possible to employ such electromagnetic vibrators without the disadvantage of unwanted distortions, which would otherwise not be possible. Specifically, it is advantageous that the compensation can be realized in the electrical domain without the need for complex (and thus error susceptible) mechanical solutions.

A hearing device may be or include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal transferred as mechanical vibrations to the user's inner ears through bone structure of the user's head and/or through parts of middle ear of the user. 'Improving or augmenting the hearing capability of a user' may include compensating for an individual user's specific hearing loss. The hearing device may further refer to a device such as a hearable, an earphone or a headset adapted to receive an audio signal electronically, possibly modifying the audio signal and providing the possibly modified audio signals as an audible signal to at least one of the user's ears.

The hearing device is adapted to be worn in any known way. This may include arranging a unit of the hearing device attached to a fixture implanted into the skull bone such as in bone anchored hearing aids, or arranging a unit of the hearing device as an entirely or partly implanted unit such as in bone anchored hearing aids.

In general, the hearing device may include i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to (relatively) enhance a target acoustic source among a multitude of acoustic sources in the user's environment and/or to attenuate other sources (e.g. noise). Thereby, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal to the ear of the user, a mechanical stimulation applied transcutaneously or percutaneously to the skull bone or a vibrator for providing a structure-borne or liquid-borne acoustic signal.

The described hearing device may be part of a hearing system. Therein, a "hearing system" refers to a system comprising one or two hearing devices, and a "binaural hearing system" or a bimodal hearing system refers to a system comprising two hearing devices where the devices are adapted to cooperatively provide audible signals to both of the user's ears either by acoustic stimulation only, acoustic and mechanical stimulation, mechanical stimulation only, acoustic and electrical stimulation, mechanical and electrical stimulation or only electrical stimulation. The hearing system, the binaural hearing system or the bimodal hearing system may further include one or more auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of a remote control, a remote microphone, an audio gateway device, a wireless communication device, e.g. a mobile phone (such as a smartphone) or a tablet or another device, e.g. comprising a graphical interface, a public-address system, a car audio system or a music player, or a combination thereof. The audio gateway may be adapted to receive a multitude of audio signals such as from an entertainment device like a TV or a music player, a telephone apparatus like a mobile telephone or a computer, e.g. a PC. The auxiliary device may further be adapted to (e.g. allow a user to) select and/or combine an appropriate one of the received audio signals (or combination of signals) for transmission to the at least one hearing device. The remote control is adapted to control functionality and/or operation of the at least one hearing device. The function of the remote control may be implemented in a smartphone or other (e.g. portable) electronic device, the smartphone/electronic device possibly running an application (APP) that controls functionality of the at least one hearing device.

Electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

In an exemplary embodiment, the distortion is one or more of a harmonic distortion in the vibration and/or a distortion due to an asymmetric behavior of the electromagnetic vibrator. The asymmetric behavior of the electromagnetic vibrator leads mainly to the harmonic distortion and less to the inharmonic distortion. Thereby, by reducing or eliminating the asymmetric behavior of the electromagnetic vibrator would result in a reduction or elimination of the harmonic and inharmonic distortion.

Thereby, harmonic distortion may be understood as the presence of overtones, wherein overtones are whole number multiples of frequencies comprised by the sound, and inharmonic distortion may be understood as a distortion resulting from general intermodulation distortion.

Further, the asymmetric behavior of the electromagnetic vibrator may refer to a dependence of a magnetic force exerted by an electromagnetic component of the electromagnetic vibrator on a vibrating component of the electromagnetic vibrator on a position of the vibrating component with respect to a position of the electromagnetic component.

In other words, in an exemplary embodiment, the magnetic force depends on the distance between the electromagnetic component and the vibrating component. In an exemplary embodiment, the magnetic force is inversely proportional to the distance squared.

At least in part compensating harmonic distortions, inharmonic distortions and/or distortions due to the asymmetric behavior of the electromagnetic vibrator advantageously allows for providing an improved user experience when using the bone anchored hearing device.

In an exemplary embodiment, the compensator is configured for receiving an uncompensated signal and/or for providing a compensated signal to the electromagnetic vibrator for at least in part compensating the distortion in the vibration of the electromagnetic vibrator.

Thereby, in an exemplary embodiment, the uncompensated signal is an (e.g. processed or unprocessed) electric input signal representing the sound from the surrounding of the user. The compensated signal may for instance be directly fed into the electromagnetic vibrator or may be processed further before being fed into the electromagnetic vibrator.

In an exemplary embodiment, when providing the uncompensated signal to the electromagnetic vibrator, at least some distortion in the vibration will occur. When providing, in an exemplary embodiment, however, the compensated signal to the electromagnetic vibrator, no or at least less distortion will occur.

No or at least less distortion in the vibration is advantageous as it enables an improved user experience when using the bone anchored hearing device.

In an exemplary embodiment, the compensated signal provided to the electromagnetic vibrator comprises one or more of the uncompensated signal and/or a compensation signal.

For instance, the compensated signal is a superposition of the uncompensated signal and the compensation signal. In other words, the compensated signal may be a convolution of the uncompensated signal and the compensation signal.

In an exemplary embodiment, the compensated signal is a modified electric input signal comprising the electric input signal and the compensation signal. Thereby, the compensation signal may in particular be an electric signal.

In an exemplary embodiment, the compensation signal is measured and/or saved in a table and/or function, and/or is calculated from physical properties of the electromagnetic vibrator. Thereby, in an exemplary embodiment, the compensation signal comprises a behavior which is the opposite of the asymmetric behavior of the electromagnetic vibrator. In other words, the compensation signal may mirror the asymmetrical behavior of the electromagnetic vibrator such that the compensation signal cancels out the asymmetric behavior of the electromagnetic vibrator. Thereby, in an exemplary embodiment, cancelling out means that when the compensated signal is provided to the electromagnetic vibrator no or at least less distortion in the vibration will occur.

The bone anchored hearing device is configured to apply a supply voltage to the vibrator based on the uncompensated signal, and by implementing the compensator into the hearing device, the hearing device is configured to apply a supply voltage to the vibrator based on the compensated signal. The uncompensated signal is an electric signal representing the sound from the surrounding of the user. The compensated signal is an electric input signal representing the sound from the surrounding of the user and a compensation of the distortion in the vibration of the electromagnetic vibrator. The hearing device may include a memory that comprises a measure of the distortion as a function of supply voltage applied to the electromagnetic vibrator. For example, the measured distortion may include measured magnetic force between the magnet and the anchor as a function of supply voltage applied to the electromagnetic vibrator. The measurement may be performed during a fitting scenario of the bone anchored hearing device to the user. The compressor receives the uncompensated signal and extracts from the memory the measured distortion as a function of the supply voltage. The compressor determines a first supply voltage based on the uncompensated signal and then determines an expected distortion as a function of the first supply voltage by the measured distortion from the memory. The compressor is then configured to determine the supply voltage to the vibrator which is determined as being symmetrical or partially symmetrically in relation to the first supply voltage. The supply voltage is then transmitted to the electromagnetic vibrator which then cancels out or reduces the distortion of the electromagnetic vibrator which would have occurred if the first supply voltage was provided to the electromagnetic vibrator.

In another example, the compensator is configured to determine the supply voltage without knowing the measured distortion. In this example the compensator is configured to determine a supply voltage to the vibrator which is symmetrical or partially symmetrically to the first supply voltage which is determined by the compensator based on the uncompensated signal.

In other words, in an exemplary embodiment, when providing the compensated signal to the electromagnetic vibrator, the magnetic force exerted by the electromagnetic component on the vibrating component does not depend on the distance between the vibrating component and the electromagnetic component anymore.

The compensator may be arranged on a printed circuit board which is arranged within the bone anchored hearing aid. The compensator receives the uncompensated signal via the receiver coil and the measured distortion from the memory. Thereby, the compensator is connected to the receiver coil and the memory.

Using a compensation signal in order to obtain the compensated signal thus advantageously allows for at least in part compensating the distortion in the vibration leading to an enhanced user experience.

In an exemplary embodiment, the compensation signal is comprised by a supply voltage of the electromagnetic vibrator, in particular of a coil of the electromagnetic vibrator.

This allows for a simple design and the compensation can be introduced into the electromagnetic vibrator by simply using a modified supply signal. As already explained, in an exemplary embodiment, the supply voltage mirrors the asymmetrical behavior of the electromagnetic vibrator. Also, in an exemplary embodiment, the supply voltage may depend on the distance between the vibrating component and the electromagnetic component inversely compared to how the magnetic force depends on the distance.

For instance, the compensator may be configured such that when the magnetic force increases or decreases due to a decreasing or increasing distance between the vibrating component and the electromagnetic component, the supply voltage is in turn decreased or increased, respectively. In order to adjust the supply voltage accordingly, a sensor may be provide measuring the distance between the vibrating component and the electromagnetic component e.g. by measuring the displacement of the vibrating component.

In an exemplary embodiment, the electromagnetic vibrator is a variable reluctance vibrator. In a variable reluctance vibrator, the magnetic reluctance may be variable, i.e. the magnetic reluctance may depend on parameters such as a place and/or time of the vibrator. Variable magnetic reluctance vibrators allow for generating a vibration by transferring the magnetic force to the vibrating component of the electromagnetic vibrator.

In an exemplary embodiment, the electromagnetic vibrator comprises one or more of a magnet and/or a coil for generating vibrations so as to transmit sound through the bone to the ear; an anchor for connecting the electromagnetic vibrator to an abutment or implant; and/or an air gap between the magnet and/or coil and the anchor.

Thereby, in an exemplary embodiment, the magnet and/or coil induce vibrations of the vibrating component by pulling and/or repelling the vibrating component, in particular periodically, by means of magnetic pull and/or magnetic repulsion. Inducing vibrations by means of magnetic pull and/or magnetic repulsion is advantageous in terms of controllability, in particular when controlling the vibrations using the electric input signal.

In an exemplary embodiment, the magnet and/or coil have a substantially circular shape. In a further exemplary embodiment, the magnet is arranged around the coil. By arranging the magnet around the coil, a particular compact device architecture is achieved.

In an exemplary embodiment, the anchor is connected to a housing by means of one or more springs, wherein the housing encloses the magnet and the coil. In a further exemplary embodiment, the anchor forms at least part of the housing.

Providing an air gap between the magnet and/or coil and the anchor is advantageous as it allows for avoiding direct mechanical contact between the electromagnetic component and the vibrating component, thereby avoiding mechanical stresses such as friction between these components which in turn enhances the durability of the bone anchored hearing device. In an exemplary embodiment, the air gap has a width of at least 60 μm.

In an exemplary embodiment, the bone anchored hearing device further comprises one or more of an implant for implantation into the bone; an abutment for connection with the implant; an input transducer for receiving sound from a surrounding of the user and providing an electric input signal representing the sound; a receiving coil for receiving electromagnetic signals; an amplifier for amplifying an electric signal; and/or a signal processing unit for processing the electric input signal and providing a processed electric signal.

In an exemplary embodiment, the implant is a screw, in particular a titanium screw, and/or the implant is applied into the skull of the patient, the implant in particular being arranged in between a skin layer of the patient and the skull of the patient. An implant, in particular a small but robust implant such as a screw, in particular a titanium screw, is advantageous in terms of user experience as in that case, e.g., a user does not have to carry the hearing device and thus cannot forget the hearing device.

In an exemplary embodiment, the abutment comprises a metal and/or is applied onto the implant. Thereby, in an exemplary embodiment, the abutment allows for transferring the vibration from the anchor through the abutment and to the skull. Using a metal is advantageous in terms of vibration properties and robustness of the abutment.

In an exemplary embodiment, the input transducer is a microphone. Thereby, in an exemplary embodiment, the input transducer allows for converting sound, i.e. acoustic waves propagating through a transmission medium, into an electric signal that may be transferred through wires and may be processed e.g. by the signal processing unit.

In an exemplary embodiment, the receiving coil is comprised by or forms an antenna. In an exemplary embodiment, the receiving coil and/or antenna are embedded into a carrier medium, e.g. silicone, which advantageously allows for the receiving coil and/or antenna to be formed as a self-contained and robust component.

In an exemplary embodiment, the amplifier amplifies the electric input signal, in particular the electric input signal induced by the input transducer. Amplifying the electric input signal is advantageous as it provides enhanced acoustic sensitivity. In other words, when a weak signal is recorded, the weak signal may be amplified by the amplifier, thereby enabling the signal to be processed e.g. by the signal processing unit.

In an exemplary embodiment, the signal processing unit is configured for processing the electric input signal and/or for providing a processed electric signal to the electromagnetic vibrator, wherein the processing comprises modifying the electric input signal in a way such as to provide an electric signal suitable for being fed into the electromagnetic vibrator.

In an exemplary embodiment, the signal processing unit is further configured for providing signal compression and/or noise reduction. Including the signal processing unit into the bone anchored hearing device is advantageous as it allows for processing, in particular digitally processing, the electric input signal such that e.g. the signal may be compressed, noise may be reduced, and/or distortions may be compensated.

In an exemplary embodiment, the compensator is configured for one or more of modifying a driving force acting on a vibrating component of the electromagnetic vibrator; modifying a supply voltage of the electromagnetic vibrator; and/or modifying the supply voltage of the electromagnetic vibrator depending on a displacement of the vibrating component of the electromagnetic vibrator.

Thereby, in an exemplary embodiment, modifying the driving force and/or the supply voltage means at least temporally increasing and/or decreasing the driving force and/or the supply voltage, respectively. Further, the displacement of the vibrating component may be understood as a deviation from a resting position of the vibrating component such that a displacement of zero indicates the vibrating component being in its resting position.

Modifying, in particular depending on the displacement of the vibrating component, the driving force and/or the supply voltage, may allow for at least in part compensating the distortion in the vibration.

In an exemplary embodiment, a compensation of the distortion is based on a dependence of a driving force acting on a vibrating component of the electromagnetic vibrator on a displacement of the vibrating component.

In an exemplary embodiment, the driving force is inversely proportional to the displacement squared. For example, quantity A being inversely proportional to quantity B results in quantity A increasing by factor of 4 when quantity B is halved and/or quantity A decreasing by a factor of 4 when quantity B is doubled.

In an exemplary embodiment, the compensation mirrors the asymmetrical behavior of the electromagnetic vibrator such that the compensation signal advantageously cancels out the asymmetric behavior of the electromagnetic vibrator.

In an exemplary embodiment, the compensator is configured to provide a compensated signal to the electromagnetic vibrator such that the driving force is substantially independent of the displacement of the vibrating component.

In other words, in an exemplary embodiment, when providing the compensated signal to the electromagnetic vibrator, the vibration of the vibrating component is the same as a vibration of a vibrating component of an electromagnetic vibrator with a fully symmetric behavior.

The compensator being configured for providing such a compensated signal to the electromagnetic vibrator is advantageous as it at least partially reduces unwanted distortions in the vibration.

In an exemplary embodiment of the signal processing method, the compensating comprises compensating a harmonic distortion in the vibration; compensating an inharmonic distortion in the vibration; and/or compensating a distortion due to an asymmetric behavior of the electromagnetic vibrator.

In an exemplary embodiment of the signal processing method, the compensating comprises modifying a driving force acting on a vibrating component of the electromagnetic vibrator; modifying a supply voltage of the electromagnetic vibrator; and/or modifying the supply voltage of the electromagnetic vibrator depending on a displacement of the vibrating component of the electromagnetic vibrator.

In an exemplary embodiment of the signal processing method, the compensating comprises generating a driving force acting on a vibrating component of the electromagnetic vibrator, wherein the driving force is substantially independent of a displacement of the vibrating component.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

DETAILED DESCRIPTION

Figure 1:
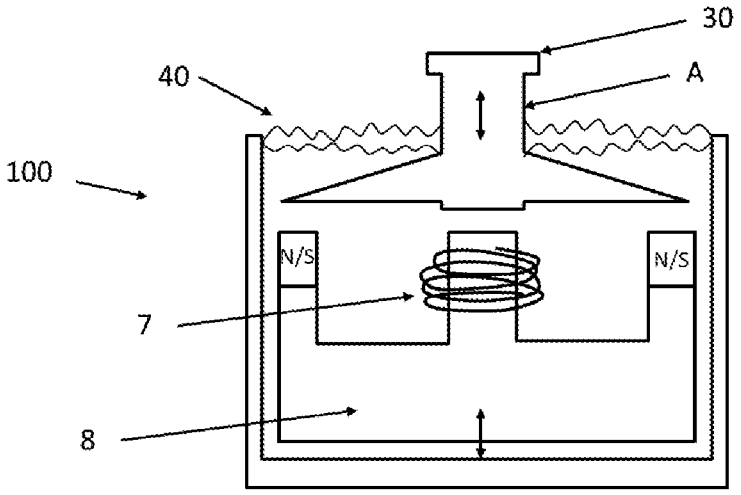
FIG. 1 schematically illustrates an electromagnetic vibrator.

The detailed description set forth below in connection with the appended drawings is intended as a description of various configurations. The detailed description includes specific details for the purpose of providing a thorough understanding of various concepts.

However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

In the following the same reference numerals will be used for the same components also in different embodiments.

FIG. 1 shows a schematic illustration of a cross section of an electromagnetic vibrator 100 comprising a magnet 8 and a coil 7 arranged around a part of the magnet (an example of the electromagnetic component), and an anchor A (an example of a vibrating component) connecting the electromagnetic vibrator 100 to an abutment 30 (an example of, part of, and/or being connected to an implant). An air gap is located in between the magnet 8, the coil 7 and the anchor A. The anchor A is further connected to a housing by means of one or more springs 40, wherein the housing encloses the magnet 8 and the coil 7. The magnet 8 comprises wolfram, in particular the magnet 8 consists of approximately 98% wolfram. When a supply voltage is provided to the electromagnetic vibrator 100, the magnet 8 and the coil 7 transfer a magnetic force to the anchor A, and the anchor A moves along a longitudinal direction (shown as double arrow) applying a vibrational force to the abutment 30, which in turn transfers the vibrational force to an implant such as a titanium screw, thereby transferring the vibration onto the skull of the patient.

Figure 2A:
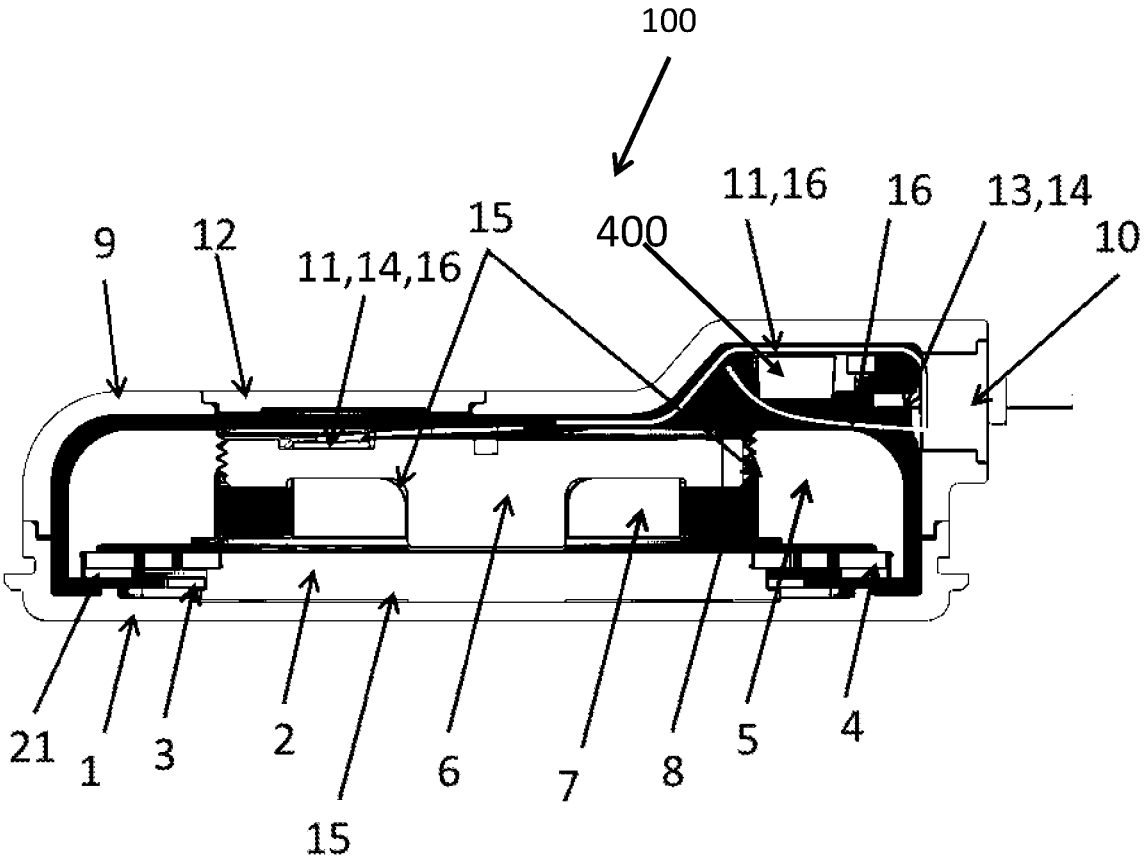
FIG. 2A schematically illustrates a further electromagnetic vibrator.

FIG. 2A shows a cross section of a further transducer in the form of an electromagnetic vibrator 100 having a casing bottom 1, a vibrator plate 2, a vibrator plate ring 3, a vibrator spring 4 and spring ring 21. Casing bottom 1 is similar to the anchor shown in FIG. 1. In a tungsten frame 5, there is arranged a bobbin 6 and a coil 7. Between the frame 5 and the coil 7 there is arranged a magnet 8. Casing bottom 1 receives a vibration from an electromagnetic component comprising magnet 8 and coil 7 and transfers the vibration via the above components onto the skull of the patient. The transducer further comprises a casing top 9 and casing lid 10 for closing the transducer. There is provided a feedthrough 10 for allowing a control signal and/or supply voltage to be provided to the transducer. The feedthrough pin 13 may be contacted via a solder 14. The transducer may comprise electronic circuits, e.g. on a PCBA 11. In this example, the PCBA may include a signal processing unit that may include a compensator 400 configured to at least in part compensating a distortion in the vibration of the electromagnetic vibrator 100. At places 15, 16 glue may be used for fixation and/or sealing of the respective components. In this case, the complete electromagnetic vibrator is an implant and the electromagnetic vibrator is arranged between a skin layer and the skull of the patient.

Figure 2B:
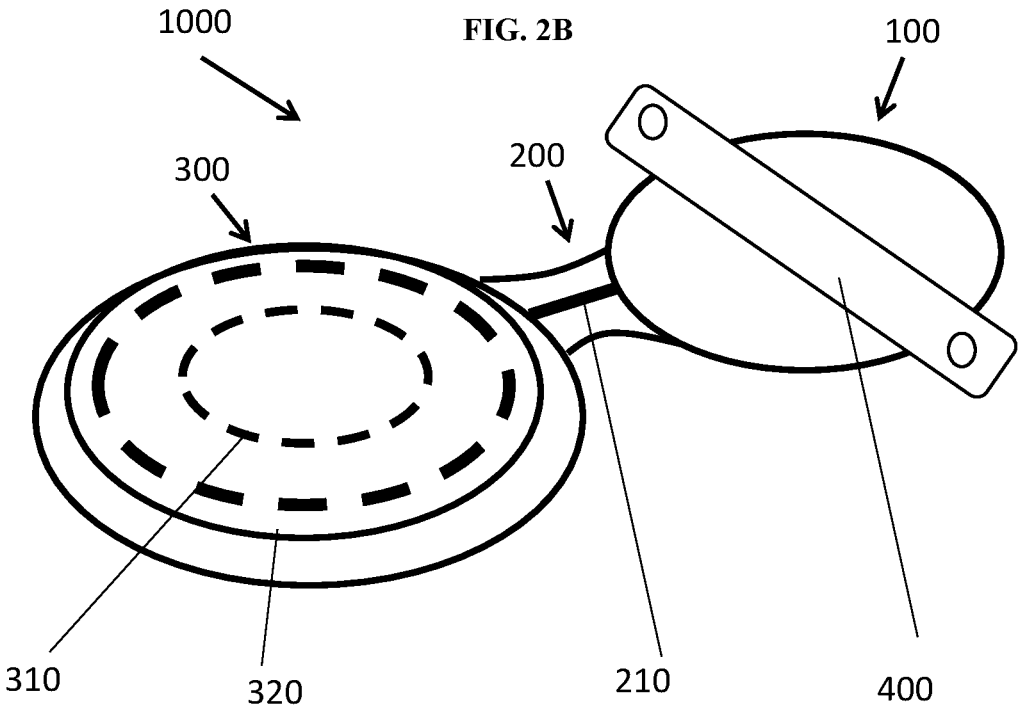
FIG. 2B schematically illustrates some components of a bone anchored hearing device comprising the electromagnetic vibrator of FIG. 2A.

FIG. 2B shows some components of a bone anchored hearing device 1000 comprising an (output) transducer 100 (an example of an electromagnetic vibrator, such as the one described above), a neck 200, and an antenna 300. Thereby, the antenna 300 comprises a magnet assembly 310 and a receiving coil 320, both being embedded into silicone. The neck 200 comprises a reinforcement 210 in order to prevent breakage and/or tearing of the device at the neck. For fixing the device to the skull of the patient, the transducer 100 is attached to a fixation band 400, which in turn may be fixed to the skull of the patient. The components shown in FIG. 2B may be wholly implantable. The compensator 400 may either be arranged within the antenna 300 or within the transducer 100 on a PCB electrically connected to the receiving coil 320.

Figure 3:
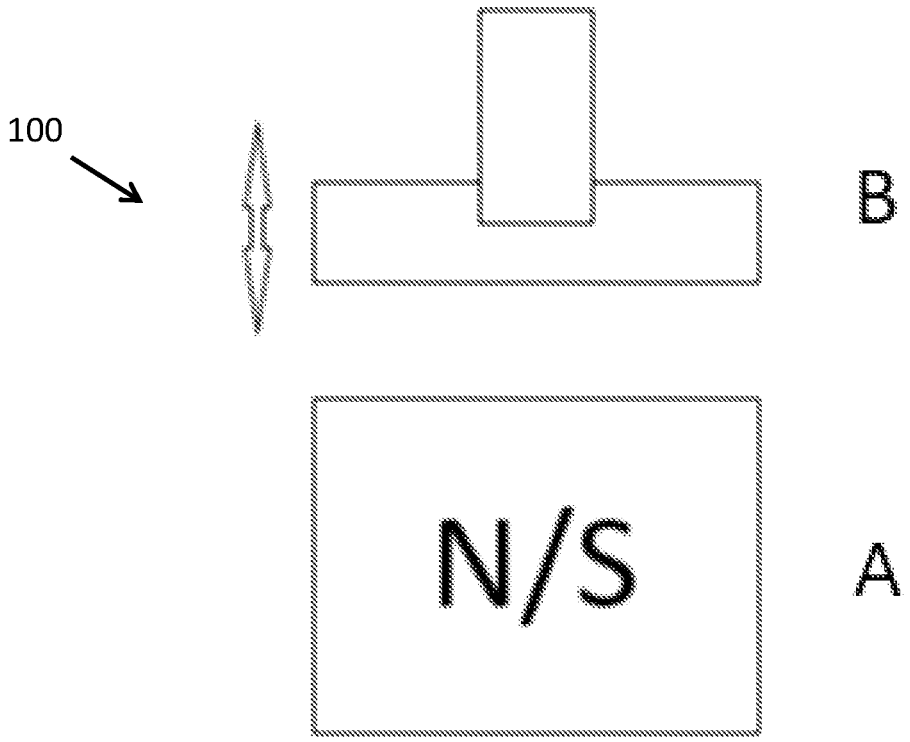
FIG. 3 schematically illustrates a simplified electromagnetic vibrator.

FIG. 3 shows a schematic illustration of a simplified electromagnetic vibrator 100 for a bone anchored hearing device comprising an electromagnet A (an example of the electromagnetic component) and an anchor B (an example of the vibrating component). Electromagnet A may be induced by the (amplified) electric input signal and, by means of a magnetic force following the electric input signal, i.e. the supply voltage, make anchor B move along a longitudinal direction, the longitudinal direction being indicated by the double arrow. Thereby, as described above, the magnetic force between electromagnet A and anchor B is inversely proportional to the distance between A and B squared. I.e., when anchor B moves away from electromagnet A, the magnetic force gets weaker and when anchor B moves closer to electromagnet A, the magnetic force gets stronger. Simplified, the proportionality may be exemplified in that if the distance gets doubled the magnetic force will be four times weaker and if the distance gets halved, the magnetic force will be four times stronger.

As a result, the anchor will move in an asymmetrical way for a symmetrical signal, e.g. a sinusoidal signal. The asymmetrical movement leads to a distorted sinusoidal signal that may be measurable and/or hearable by the patient, e.g. when playing loud music.

In other words, for small signals, i.e. small movements of the anchor, the distortion is small. For larger signals, i.e. larger movements of the anchor, the distortion increases, thereby possibly becoming measurable and/or hearable.

Figure 4:
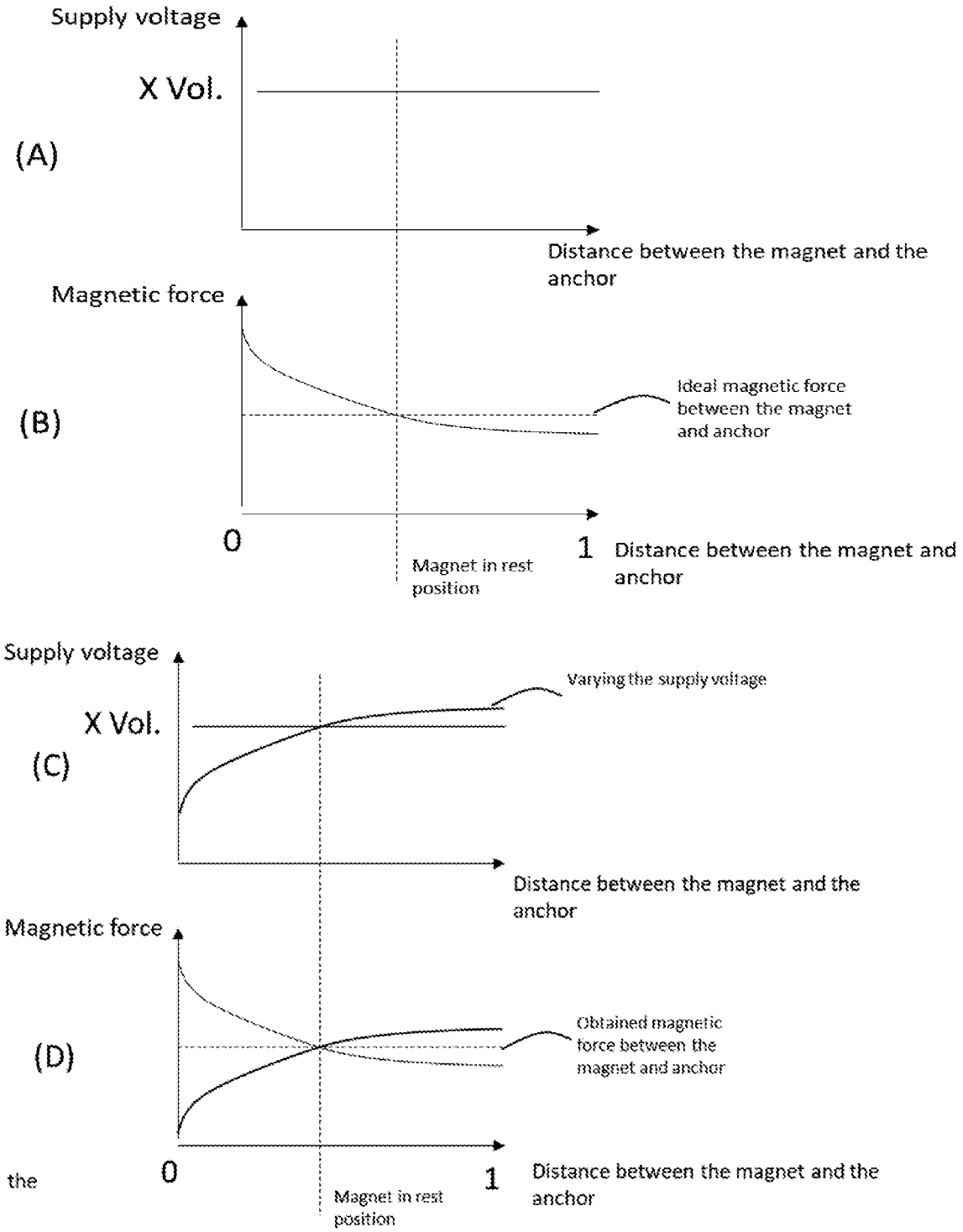
FIG. 4 comprises panels (A)-(D), wherein panels (A) and (B) schematically illustrate a supply voltage and a magnetic force both as a function of a distance between a magnet and an anchor for a constant supply voltage, and wherein panels (C) and (D) schematically illustrate a supply voltage and a magnetic force according to an exemplary embodiment both as a function of the distance between the magnet and the anchor for a varying supply voltage.

FIG. 4 shows panels (A)-(D). All quantities shown in FIG. 4 are given in arbitrary units, meaning that a behavior of the quantities may only be interpreted qualitatively.

Panel (A) shows a supply voltage of an electromagnetic vibrator (solid horizontal line) as a function of a distance between a magnet and an anchor of the electromagnetic vibrator for a constant supply voltage (a constant supply voltage profile). Panel (B) shows a magnetic force between the magnet and the anchor (solid line) as a function of the distance for a constant supply voltage as shown in panel (A). As can be seen in panel (B), as the distance increases from 0 to 1, the magnetic force decreases. Ideally, the magnetic force should be the same no matter where the magnet and/or anchor are (dashed horizontal line). The rest position of the anchor and/or the magnet is shown as a vertical, dashed line (panels (A) and (B)).

Panel (C) shows a supply voltage (solid line) according to an exemplary embodiment as a function of the distance between the magnet and the anchor. Thereby, the supply voltage is not constant as in panel (A), but varies depending on the distance. Specifically, as the distance increases from 0 to 1, the supply voltage increases as well. Panel (D) shows the magnetic force (solid grey line) as a function of the distance for a constant supply voltage as shown in panel (A), and the varied supply voltage (solid black line) shown in panel (C). As can be seen, the dependence of the supply voltage on the distance is the exact opposite of the dependence of the magnetic force on the distance. As a result, as can be seen in panel (D), the dependencies of the supply voltage and the magnetic force on the distance cancel out, such that a constant magnetic force (dashed horizontal line) between the magnet and the anchor is achieved. In practical, there may appear some small variations in the supply voltage due to load variations on the power storage, and therefore, the resulting magnetic force does not become ideally constant, but the unwanted variation in the magnetic force has been reduced significantly. As described in detail above, such a constant magnetic force or nearly constant magnetic force is advantageous in terms of avoiding measurable and/or hearable distortions of the vibration and thereby improving user experience of the bone anchored hearing device.

Figure 5:
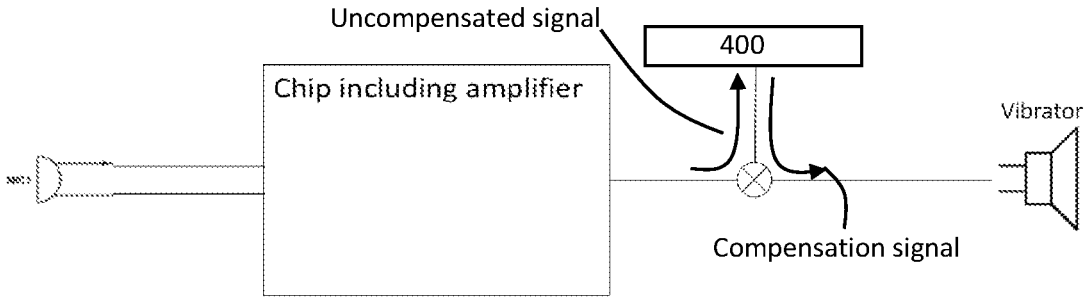
FIG. 5 schematically illustrates a block diagram of some components of a bone anchored hearing device according to an exemplary embodiment.

FIG. 5 shows a block diagram of some components of a bone anchored hearing device comprising a microphone ("MIC1"), a chip including an amplifier, a compensator, an input port for adding the compensation signal and an (electromagnetic) vibrator. The input port is connected to the compensator 400 which is also part of the bone anchored hearing device. The compensation signal may be applied at several stages along a path of the electric signal. As shown in FIG. 5, the input port for adding the compensation signal may be located in between the chip including the amplifier and the electromagnetic vibrator. Adding the compensation signal right before the electromagnetic vibrator is advantageous as it allows for adding the compensation signal right before the processed electric signal is used by the electromagnetic vibrator to generate a vibration, thereby avoiding possible noise which might be introduced to the compensation signal, for example in case the compensation signal would be added earlier on. However, other locations for adding the compensation signal, e.g. in between the microphone and the chip, are possible as well. In this example the compensation signal includes a supply voltage for the vibrator, and wherein the supply voltage is determined based on the uncompensated signal received from the chip. In another example, the compensator is connected to a memory which includes a measured distortion as a function of a supply voltage of the vibrator. In this example, the compensator is configured to determine the compensation signal based on the uncompensated signal and the measured distortion.

Figure 6A:
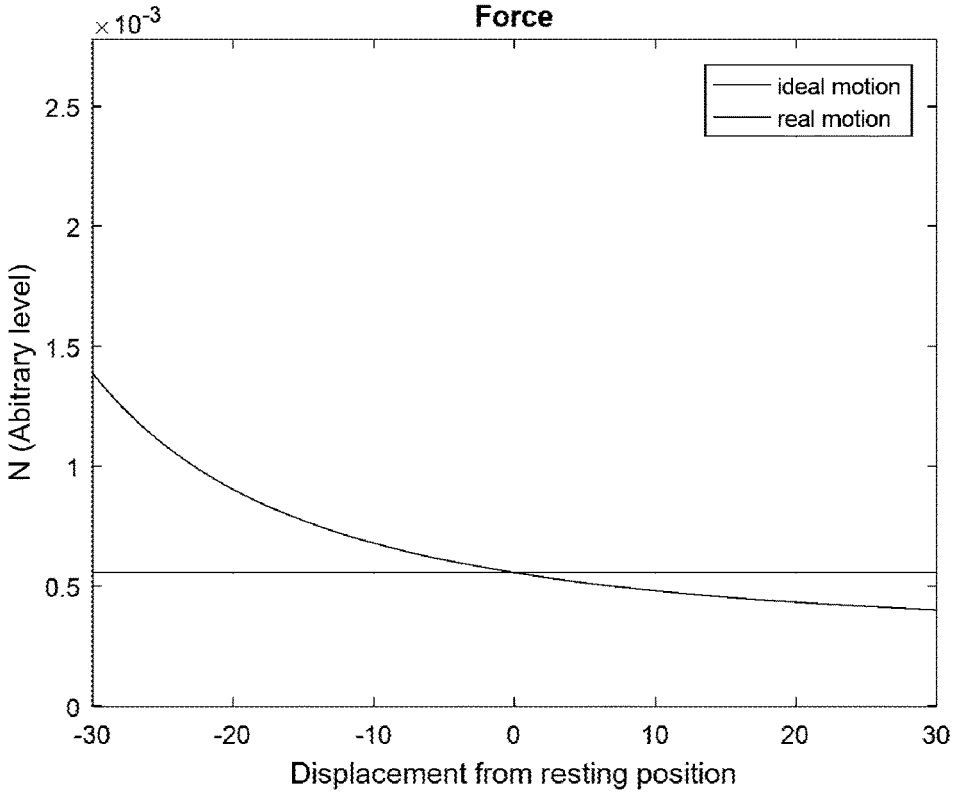
FIG. 6A schematically illustrates a magnetic force as a function of a displacement of a vibrating component for a real motion and for an ideal motion.

FIG. 6A shows the magnetic force as a function of the displacement of the vibrating component for a real motion and for an ideal motion. FIG. 6A shows the same relationship which is shown in FIG. 4, panel (B), whereby here, the x-axis shows the displacement of the vibrating component from its resting position (−30 to +30) instead of the distance between the magnet and the anchor (0 to 1). In other words, FIG. 6A shows a simulation of the magnetic force in the air gap between the magnet and/or coil and the anchor. Thereby, the solid horizontal line shows the magnetic force of an ideal electromagnetic vibrator, the magnetic force being constant for a whole working range of the electromagnetic vibrator.

The solid curved line, on the other hand, shows a simulation of a movement due to the asymmetrical behavior of the electromagnetic vibrator (real motion). Thereby, when the vibrating component moves away from the electromagnetic component (positive displacement), the magnetic force gets weaker, and when the vibrating component moves closer to the electromagnetic component (negative displacement), the magnetic force gets stronger. A displacement of zero indicates the vibrating component being in its resting position.

It should be noted that in praxis the magnetic field extends beyond the air gap and hence the magnetic field is more homogeneous. In praxis, a deviation of the real motion from the ideal motion therefore is smaller than shown in FIG. 6A. In praxis, the deviation of the magnetic force in an electromagnetic vibrator will be less than or equal to 10%, in particular less than or equal to 5%. However, even such a relatively small deviation is unwanted as it might also induce measurable and/or hearable distortions.

Figure 6B:
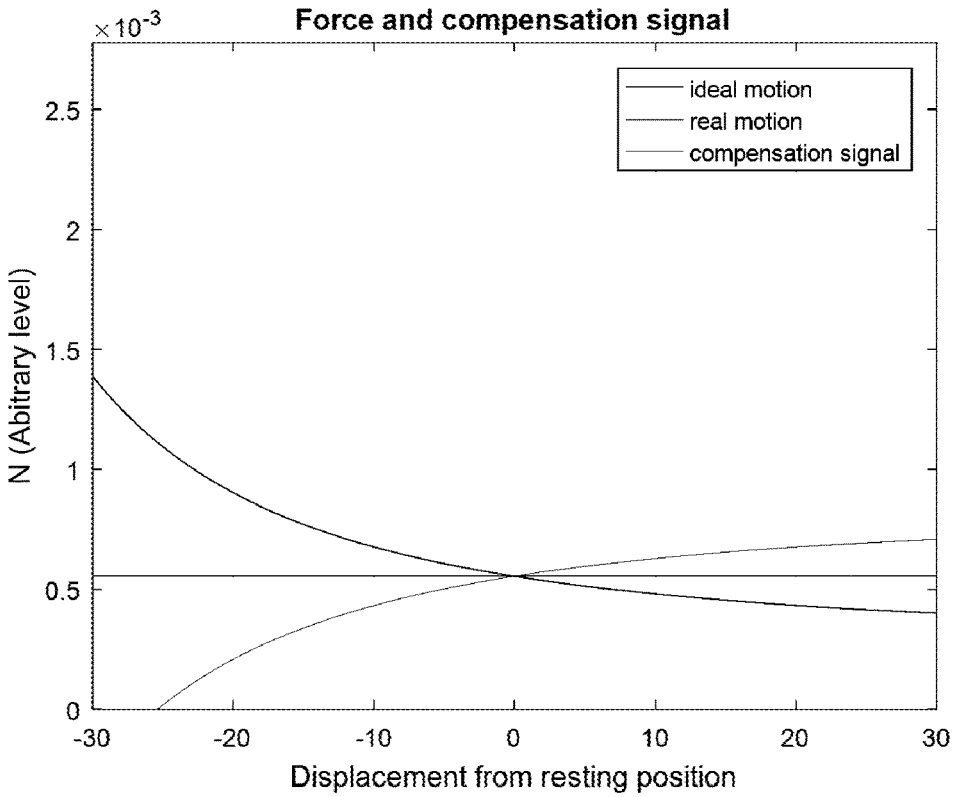
FIG. 6B schematically illustrates the magnetic force shown in FIG. 6A and further a compensation signal according to an exemplary embodiment as a function of the displacement of the vibrating component.

FIG. 6B shows the same magnetic forces shown in FIG. 6A, but further includes the compensation signal according to an exemplary embodiment as a function of the displacement of the vibrating component. In other words, FIG. 6B shows the same relationship which is shown in FIG. 4, panel (D), whereby the x-axis shows the displacement of the vibrating component from its resting position (−30 to +30) instead of the distance between the magnet and the anchor (0 to 1). Thereby, the compensation signal mirrors the asymmetrical movement of the anchor such that the compensation signal cancels out the asymmetric movement of the anchor, which alone would generate distortions. After adding the compensation signal to the electric input signal, an actual movement of the anchor will be the same as a movement of the anchor in case of a constant magnetic force through the whole movement, i.e. will equal the ideal motion (solid horizontal line).

A computer program (product) comprising instructions which, when the program is executed by a computer, cause the computer to carry out (steps of) the method described above, in the 'detailed description of embodiments' and in the claims is furthermore provided by the present application.

In an aspect, the functions may be stored on or encoded as one or more instructions or code on a tangible computer-readable medium. The computer readable medium includes computer storage media adapted to store a computer program comprising program codes, which when run on a processing system causes the data processing system to perform at least some (such as a majority or all) of the steps of the method described above, in the and in the claims.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

In an aspect, a data processing system comprising a processor adapted to execute the computer program for causing the processor to perform at least some (such as a majority or all) of the steps of the method described above and in the claims is provided.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects. Reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A bone anchored hearing device comprising:

an input transducer configured to provide an electric input signal representing sound of a surrounding of a user of the bone anchored hearing device;

a signal processing unit configured to process the electric input signal and provide a processed electric signal;

an electromagnetic vibrator for generating a vibration in order to transmit sound through a bone of a user to an ear of the user based on the processed electric signal; and a compensator for at least in part compensating a distortion in the vibration of the electromagnetic vibrator, wherein a compensation of the distortion is based on a dependence of a driving force acting on a vibrating component of the electromagnetic vibrator on a displacement of the vibrating component.

2. The bone anchored hearing device of claim 1, wherein the distortion is one or more of a harmonic distortion in the vibration;

an inharmonic distortion in the vibration; and/or a distortion due to an asymmetric behavior of the electromagnetic vibrator.

3. The bone anchored hearing device of claim 2, wherein the compensator is configured for receiving an uncompensated signal and/or for providing a compensated signal to the electromagnetic vibrator for at least in part compensating the distortion in the vibration of the electromagnetic vibrator.

4. The bone anchored hearing device of claim 2, wherein the electromagnetic vibrator is a variable reluctance vibrator.

5. The bone anchored hearing device of claim 2, wherein the electromagnetic vibrator comprises one or more of:

a magnet and/or a coil for generating vibrations so as to transmit sound through the bone to the ear;

an anchor for connecting the electromagnetic vibrator to an abutment or implant; and/or an air gap between the magnet and/or coil and the anchor.

6. The bone anchored hearing device of claim 1, wherein the compensator is configured for receiving an uncompensated signal and/or for providing a compensated signal to the electromagnetic vibrator for at least in part compensating the distortion in the vibration of the electromagnetic vibrator.

7. The bone anchored hearing device of claim 6, wherein the compensation signal is comprised by a supply voltage of the electromagnetic vibrator, in particular of a coil of the electromagnetic vibrator.

8. The bone anchored hearing device of claim 7, wherein the electromagnetic vibrator is a variable reluctance vibrator.

9. The bone anchored hearing device of claim 6, wherein the electromagnetic vibrator is a variable reluctance vibrator.

10. The bone anchored hearing device of claim 6, wherein the electromagnetic vibrator comprises one or more of:

a magnet and/or a coil for generating vibrations so as to transmit sound through the bone to the ear;

an anchor for connecting the electromagnetic vibrator to an abutment or implant; and/or an air gap between the magnet and/or coil and the anchor.

11. The bone anchored hearing device of claim 1, wherein the electromagnetic vibrator is a variable reluctance vibrator.

12. The bone anchored hearing device of claim 1, wherein the electromagnetic vibrator comprises one or more of:

a magnet and/or a coil for generating vibrations so as to transmit sound through the bone to the ear;

an anchor for connecting the electromagnetic vibrator to an abutment or implant; and/or an air gap between the magnet and/or coil and the anchor.

13. The bone anchored hearing device of claim 1, further comprising one or more of:

an implant for implantation into the bone;

an abutment for connection with the implant;

an input transducer for receiving sound from a surrounding of the user and providing an electric input signal representing the sound;

a receiving coil for receiving electromagnetic signals;

an amplifier for amplifying an electric signal; and/or a signal processing unit for processing the electric input signal and providing a processed electric signal.

14. The bone anchored hearing device of claim 1, wherein the compensator is configured for one or more of:

modifying a driving force acting on a vibrating component of the electromagnetic vibrator;

modifying a supply voltage of the electromagnetic vibrator; and/or modifying the supply voltage of the electromagnetic vibrator depending on a displacement of the vibrating component of the electromagnetic vibrator.

15. The bone anchored hearing device of claim 1, wherein the compensator is configured to provide a compensated signal to the electromagnetic vibrator such that the driving force is substantially independent of the displacement of the vibrating component.

16. A signal processing method for a bone anchored hearing device, in particular a bone anchored hearing device according to claim 1, the method comprising:

providing, by an input transducer, an electric input signal representing sound of a surrounding of a user of the bone anchored hearing device;

processing, by a signal processing unit, the electric input signal and providing a processed electric signal;

generating, by an electromagnetic vibrator, based on the processed electric signal, a vibration in order to transmit sound through a bone of the user to an ear of the user; and at least in part compensating, by a compensator, a distortion in the vibration of the electromagnetic vibrator, wherein a compensation of the distortion is based on a dependence of a driving force acting on a vibrating component of the electromagnetic vibrator on a displacement of the vibrating component.

17. The signal processing method of claim 16, the compensating comprising:

compensating a harmonic distortion in the vibration;

compensating an inharmonic distortion in the vibration; and/or compensating a distortion due to an asymmetric behavior of the electromagnetic vibrator.

18. The signal processing method of claim 16, the compensating comprising:

modifying a driving force acting on a vibrating component of the electromagnetic vibrator;

modifying a supply voltage of the electromagnetic vibrator; and/or modifying the supply voltage of the electromagnetic vibrator depending on a displacement of the vibrating component of the electromagnetic vibrator.

19. The signal processing method of claim 16, the compensating comprising generating a driving force acting on a vibrating component of the electromagnetic vibrator, wherein the driving force is substantially independent of a displacement of the vibrating component.

* * * * *